US008465135B2

(12) United States Patent
Kawate

(10) Patent No.: US 8,465,135 B2
(45) Date of Patent: Jun. 18, 2013

(54) LIQUID CONTAINER FOR USE WITH LIQUID CONSUMING DEVICES

(75) Inventor: Hiroyuki Kawate, Chino (JP)

(73) Assignee: Seiko Epson Corporation, Tokyo (JP)

( * ) Notice: Subject to any disclaimer, the term of this patent is extended or adjusted under 35 U.S.C. 154(b) by 55 days.

(21) Appl. No.: 13/070,397

(22) Filed: Mar. 23, 2011

(65) Prior Publication Data

US 2011/0234718 A1 Sep. 29, 2011

(30) Foreign Application Priority Data

Mar. 25, 2010 (JP) ..... 2010-069448
Jan. 17, 2011 (JP) ..... 2011-006644

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS

| | | | | |
|---|---|---|---|---|
| 6,155,678 | A * | 12/2000 | Komplin et al. | 347/86 |
| 6,955,422 | B2 * | 10/2005 | Miyazawa et al. | 347/86 |
| 7,018,030 | B2 * | 3/2006 | Seino et al. | 347/86 |
| 7,213,914 | B2 * | 5/2007 | Anma et al. | 347/86 |
| 7,971,977 | B2 * | 7/2011 | Nakata et al. | 347/86 |
| 2004/0135857 | A1 | 7/2004 | Hashii et al. | |
| 2005/0146580 | A1 | 7/2005 | Hashii et al. | |
| 2005/0200670 | A1 | 9/2005 | Hashii et al. | |
| 2006/0152564 | A1 | 7/2006 | Hashii et al. | |
| 2007/0103515 | A1 | 5/2007 | Hashii et al. | |
| 2007/0273734 | A1 | 11/2007 | Nakata et al. | |
| 2008/0239036 | A1 | 10/2008 | Hattori | |
| 2009/0066768 | A1 | 3/2009 | Hashii et al. | |
| 2009/0096851 | A1 | 4/2009 | Sulser | |
| 2009/0141100 | A1 | 6/2009 | Nakamura et al. | |

FOREIGN PATENT DOCUMENTS

| | | | |
|---|---|---|---|
| EP | 0 698 497 | A2 | 2/1996 |
| EP | 0 755 794 | A2 | 1/1997 |
| EP | 1 547 783 | A2 | 6/2005 |
| GB | 2 440 837 | A | 2/2008 |
| JP | 2005-074979 | A | 3/2005 |
| JP | 2009-214548 | A | 9/2009 |

* cited by examiner

*Primary Examiner* — Matthew Luu
*Assistant Examiner* — Michael Konczal
(74) *Attorney, Agent, or Firm* — Kilpatrick Townsend & Stockton LLP

(57) ABSTRACT

The liquid container has a fixing lever, a first surface, a second surface, a third surface, and a corner. The fixing lever engages with a designated portion of the liquid consuming device, thereby fixing the liquid container in the liquid consuming device. The fixing lever is provided on the first surface. A liquid supply port for supplying liquid to the liquid consuming device is provided on the second surface. The third surface corresponds to a surface facing opposite the second surface or to a top surface of the liquid container in a state with the liquid container mounted on the liquid consuming device. The corner has a cutout in contact with the first surface and the third surface.

8 Claims, 5 Drawing Sheets

122
116

116
114
116
100
118
115
104
142
D
104
106
106
141
102
108
110
120
112

112
121

LIQUID CONTAINER FOR USE WITH LIQUID CONSUMING DEVICES

CROSS-REFERENCE TO RELATED APPLICATIONS

The present application claims the priorities based on Japanese Patent Applications No. 2010-69448 filed on Mar. 25, 2010, and No. 2011-6644 filed on Jan. 17, 2011 the disclosures of which are hereby incorporated by reference in their entireties.

BACKGROUND

1. Technical Field

The present invention relates to a liquid container, which is to be mounted on a liquid consumption device.

2. Related Art

Some types of printer ink cartridges are equipped with a fixing lever, which is used for detaching and fixing an ink cartridge in a printer (see JP-A-2009-214548, for example). Usually such fixing levers are provided on a surface of the ink cartridge other than its top surface, and this makes operation of the fixing lever difficult and decreases detachability of the ink cartridge, especially in cases where the size and shape of the ink cartridge body are difficult to handle. This kind of problem is not limited to printer ink cartridges, but is a problem common to liquid containers which are to be mounted on various types of liquid consuming devices.

SUMMARY

Detachability of liquid containers in liquid consuming devices is improved according to some or other aspect of the present invention described below.

According to an aspect of the present invention, there is provided a liquid container, which is to be mounted on a liquid consuming device. The liquid container has a fixing lever, a first surface, a second surface, a third surface, and a corner. The fixing lever engages with a designated portion of the liquid consuming device, thereby fixing the liquid container in the liquid consuming device. The fixing lever is provided on the first surface. A liquid supply port for supplying liquid to the liquid consuming device is provided on the second surface. The third surface corresponds to a surface facing opposite the second surface or to a top surface of the liquid container in a state with the liquid container mounted on the liquid consuming device. The corner has a cutout in contact with the first surface and the third surface.

With this liquid container, when the liquid container is mounted on the liquid consuming device, it is possible to easily operate the fixing lever through the cutout. Accordingly, it is possible to increase the detachability of the liquid container.

It is preferable that the fixing lever has a fixed end fixed on the first surface, and a free end that is displaceable toward the first surface during mounting operation of the liquid container to the liquid consuming device, and when seen in the direction along the first surface, the free end is located closer to the third surface than the fixed end is.

With this constitution, since the free end of the fixing lever is provided closer to the third surface side than the fixed end is, it is possible to easily operate the fixing lever through the cutout.

The cutout of the corner may be provided near a position of the free end when the free end of the fixing lever is displaced toward the first surface With this constitution, since the cutout is arranged near the free end of the fixing lever in a state with the liquid container mounted on the liquid consuming device, it is possible to improve the operability of the fixing lever.

The cutout of the corner may be constructed such that it meets the first surface near a position of the first surface which is opposite to the free end of the fixing lever when the free end is displaced toward the first surface.

With this constitution, in a state with the liquid container mounted on the liquid consuming device, it is possible to provide a cutout further to the top side (third surface side) than the fixing lever. Accordingly, it is possible to suppress a decrease in operability of the fixing lever when the shape of the liquid container expands to the top side (third surface side) due to an increase in the liquid capacity of the container.

The liquid container may further have a projected portion that projects further to the third surface side than the free end of the fixing lever in the direction along the first surface, wherein the corner having the cutout is provided in the projected portion.

With this constitution, since the projected portion is provided in the liquid container, and the corner having the cutout is provided at this projecting portion, it is possible to increase the liquid capacity of the liquid container with the capacity of the projected portion. Also, by providing the cutout in this projected portion, it is possible to suppress a decrease in the operability of the fixing lever due to the existence of the projected portion.

The cutout of the corner may be formed by one or more flat surfaces, one or more curved surfaces, or a combination of one or more flat surfaces and curved surfaces. In this way, the cutout may be made in various shapes.

In addition to a constitution of the liquid container described above, the present invention may also be constituted, for example, as a liquid container manufacturing method or use method, a liquid consuming device equipped with a liquid holding device, or a method of detaching a liquid container on a liquid consuming device or the like.

DESCRIPTION OF EXEMPLARY EMBODIMENTS

A. First Embodiment

Figures 1A, 1B, 1C, 1D:
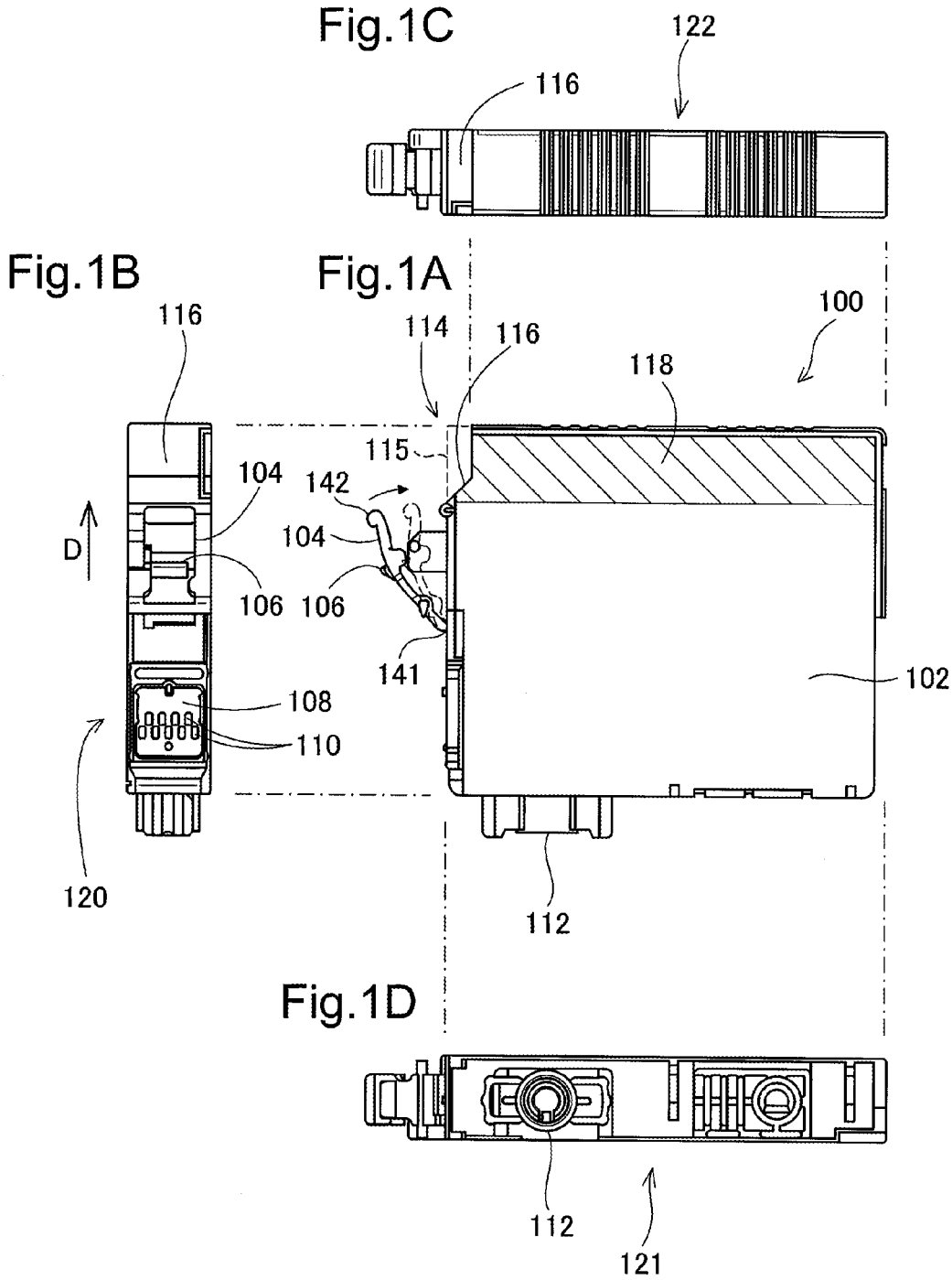
FIGS. 1A-1D are drawings of an ink cartridge as a first embodiment of the present invention.

FIGS. 1A-1D are drawings of an ink cartridge 100 as a first embodiment of the present invention. FIG. 1A is a side view of the ink cartridge 100, FIG. 1B is a front view, FIG. 1C is a plan view, and FIG. 1D is a bottom view.

As shown in FIG. 1A, the ink cartridge 100 has an ink container portion 102 of a substantially rectangular parallelepiped shape. As shown in FIG. 1B, a fixing lever 104 for fixing the ink cartridge 100 in the printer is provided on the front surface (first surface) 120 of this ink container portion 102. One end of the fixing lever 104 is a fixed end 141 fixed at roughly the center of the front surface 120 of the ink container portion 102, and the other end is a free end 142 extending diagonally upward. The free end 142 is flexibly pushed towards the ink container portion 102. The direction D shows a direction from the bottom surface 121 towards the top surface 122 along the front surface 120. When seen in this direction D the free end 142 of the fixing lever 104 is provided closer to the top surface 122 than the fixed end 141 is. A claw 106 is provided on the outside of the fixing lever 104. The claw 106 is to be engaged with an engaging hole in the printer, thereby being fixed in the printer. At the bottom of the front surface 120 of the ink container portion 102 is attached a circuit board 108 to which a non-volatile memory (not illustrated) is mounted. The circuit board 108 has a plurality of terminals 110 to be in electrical contact with the printer circuitry when the ink cartridge 100 is mounted on the printer.

As shown in FIG. 1D, on the bottom surface (second surface) 121 of the ink container portion 102 is provided an ink supply port 112 for supplying ink to the printer. This ink supply port 112 is provided near the front surface 120 at which the fixing lever 104 is provided.

As shown in FIG. 1A, 1B, and 1C, a cutout portion 116 is provided at the corner 114, which corresponds to an intersection of the front surface 120 and the top surface (third surface) 122; in other words, the corner 114 and the cutout portion 116 are in contact with both the front surface 120 and the top surface 122. This cutout portion 116 is located at the vicinity of and above the free end 142 when the free end 142 is displaced towards the front surface 120. In other words, the position at which the cutout portion 116 meets the front surface 120 is near the position of the front surface 120 which is opposite to the free end 142 when the free end 142 is displaced towards the front surface 102. With this embodiment, the cutout portion 116 is constituted by two surfaces, a flat surface extending diagonally upward, and another flat surface extending parallel to the front surface 120. The word "cutout", however, denotes any portion obtained by: forming a virtual corner 115 by virtually extending the first surface 120 toward the third surface 122 and extending the third surface 122 toward the first surface 120; and cutting out part of the virtual corner 115 to form one or more surfaces which are in contact with the first surface 120 and the third surface 122.

As shown in FIG. 1A, a top portion of the ink container portion 102 constitutes a projected portion 118 (cross hatched in FIG. 1A); the projected portion 118 projects more to the third surface (top surface) 122 side than the position of the fixing lever's free end 142 in the direction D. This allows the ink cartridge 100 of the present embodiment to hold more ink or liquid than conventional ink cartridges or liquid containers due to the increased capacity of the projected portion 118. The cutout portion 116 is provided to this projected portion 118.

Figure 2:
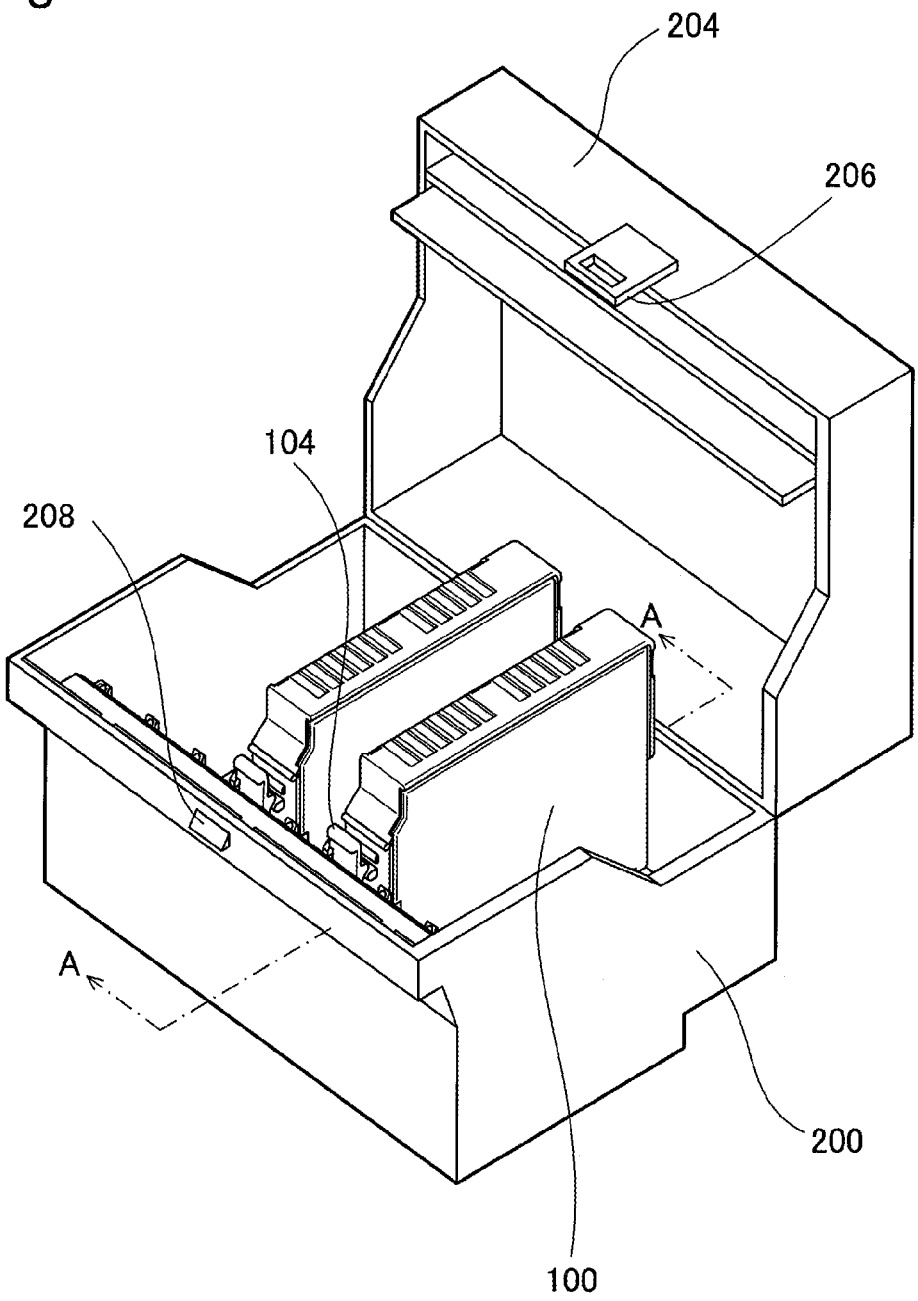
FIG. 2 is a first perspective view showing the state with an ink cartridge mounted on a cartridge mounting portion in the printer.
Figure 3:
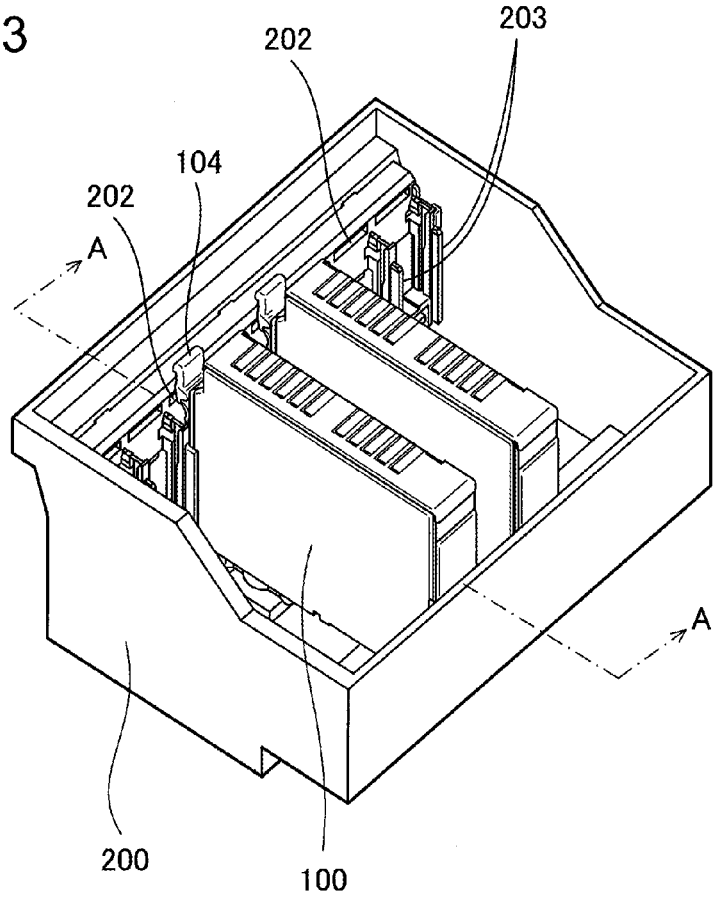
FIG. 3 is a second perspective view showing the state with an ink cartridge mounted on a cartridge mounting portion in the printer.

FIG. 2 and FIG. 3 are perspective drawings showing the state where the ink cartridge 100 is mounted on the cartridge mounting portion (or cartridge holder) 200 in the printer. The cartridge mounting portion 200 has an engaging hole 202 that is to be engaged with the claw 106 of the fixing lever 104 of the ink cartridge 100. When the ink cartridge 100 is inserted downward along guides 203 into the cartridge mounting portion 200, the free end 142 of the fixing lever 104 of the ink cartridge 100 is pushed by the housing of the cartridge mounting portion 200 to be displaced toward the ink container portion 102. Then the claw 106 of the fixing lever 104 is engaged in the engaging hole 202, and the ink cartridge 100 is fixed in the cartridge mounting portion 200.

The cartridge mounting portion 200 has a cover 204 that opens and closes around a rotation axis (omitted in FIG. 3) near the back surface side of the ink cartridge 100. The cover 204 has a hook 206, which engages with a claw 208 of the cartridge mounting portion 200, thereby fixing the cover 204 on the cartridge mounting portion 200.

Figure 4:
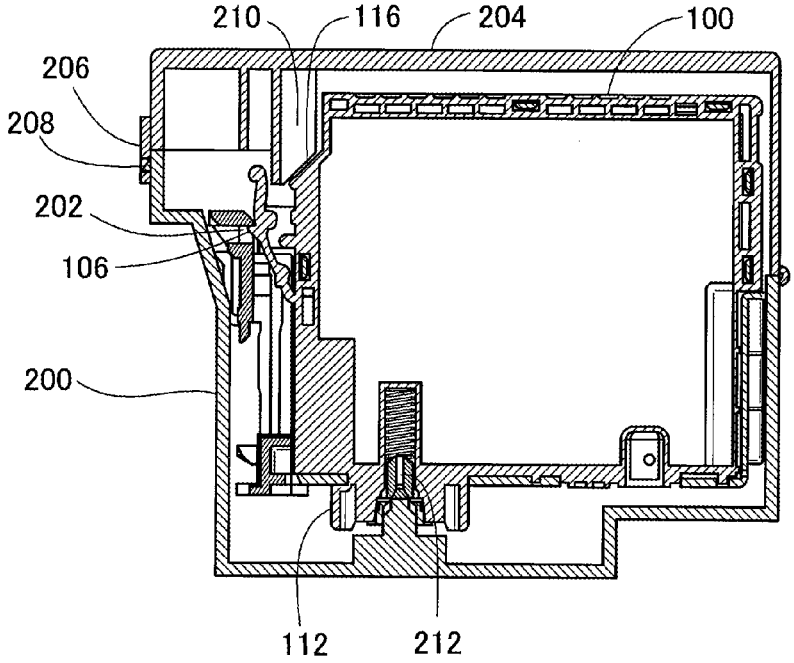
FIG. 4 is a cross section view of a state with an ink cartridge mounted on a cartridge mounting part.

FIG. 4 is a cross section view of the ink cartridge 100 and the cartridge mounting portion 200. This shows the A-A cross section of FIG. 2 and that of FIG. 3 with the cover 204 shut. As shown in FIG. 4, when the ink cartridge 100 is mounted in the cartridge mounting portion 200, an ink receiving needle 212 of the cartridge mounting portion 200 is inserted into the ink supply port 112 of the ink cartridge 100, and also the claw 106 of the fixing lever 104 is engaged in an engaging hole 202 in the cartridge mounting portion 200. Then, the cover 204 is closed over the top part of the ink cartridge 100 to be fixed on the top part of the cartridge mounting portion 200 with the engagement of the hook 206 and the claw 208. When the cover 204 is fixed in this way, the cutout portion 116 of the ink cartridge 100 is pressed downward by a pressing member 210 provided on the inner surface of the cover 204.

When the ink cartridge 100 is to be removed from the cartridge mounting portion 200, the hook 206 is disengaged from the claw 208 and the cover 204 is opened. Then, the user inserts his or her finger near the cutout portion 116, and pushes or displaces the free end 142 of the fixing lever 104 toward the front surface 120 of the ink container portion 102. By doing this, the claw 106 of the fixing lever 104 is disengaged from the engaging hole 202 of the cartridge mounting unit 200, so it is possible to pull upward and remove the ink cartridge 100.

With the ink cartridge 100 of this embodiment, the cutout portion 116 is provided near the free end 142 of the fixing lever 104 provided on the front surface 120 side of the ink container portion 102; the cutout portion 116 effects easy operation of the fixing lever 104 in a state where the ink cartridge 100 is mounted on the cartridge mounting portion 200. Accordingly, it is possible to increase the detachability of the ink cartridge 100 from the printer. Also, with this embodiment, the cutout portion 116 is located at the vicinity of and above the free end 142 of the fixing lever 104, so even when the capacity of the ink cartridge 100 is expanded toward the upper part of the ink cartridge 100, it is possible to easily operate the fixing lever 104. Because of that, it is possible to expand the capacity of the ink cartridge 100 without making major changes to the structure of the printer cartridge mounting portion 200.

Figure 5:
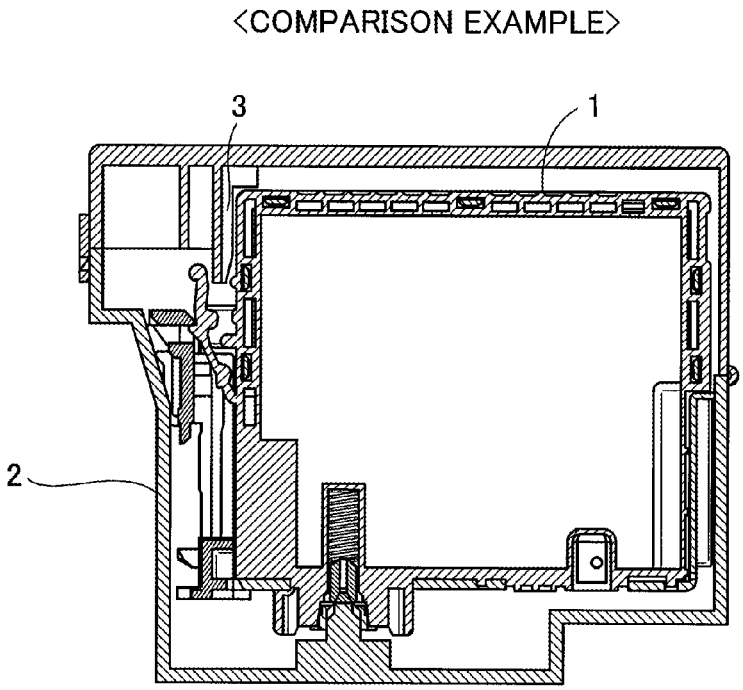
FIG. 5 is a cross section view of a state with an ink cartridge that is not equipped with a cutout portion mounted on the cartridge mounting part.

Also, with this embodiment, when the ink cartridge 100 is mounted on the cartridge mounting portion 200, the cutout portion 116 is pressed by the pressing member 210 formed inside the cover 204 as shown in FIG. 4. FIG. 5 shows a comparison example where an ink cartridge 1 does not have the cutout portion 116. With the kind of constitution shown in FIG. 5, a pressing member 3 for pressing the ink cartridge is far smaller. With this embodiment shown in FIG. 4, on the other hand, the cutout portion 116 provides a larger space between the ink cartridge 100 and the cartridge mounting portion 200 to accommodate a larger pressing member 210. This makes it possible to press and fix the ink cartridge 100 well from above.

Furthermore, with this embodiment, because the ink supply port 112 and circuit board 108 are arranged roughly directly beneath the cutout portion 116, it is possible to fix the ink supply port 112 and the circuit board 108 stably in the printer by downwardly pressing the cutout portion 116. Because of that, it is possible to reliably perform supplying of ink to the printer and electrical connection of the circuit board 108 and the printer internal circuitry.

B. Other Embodiments

Figure 6:
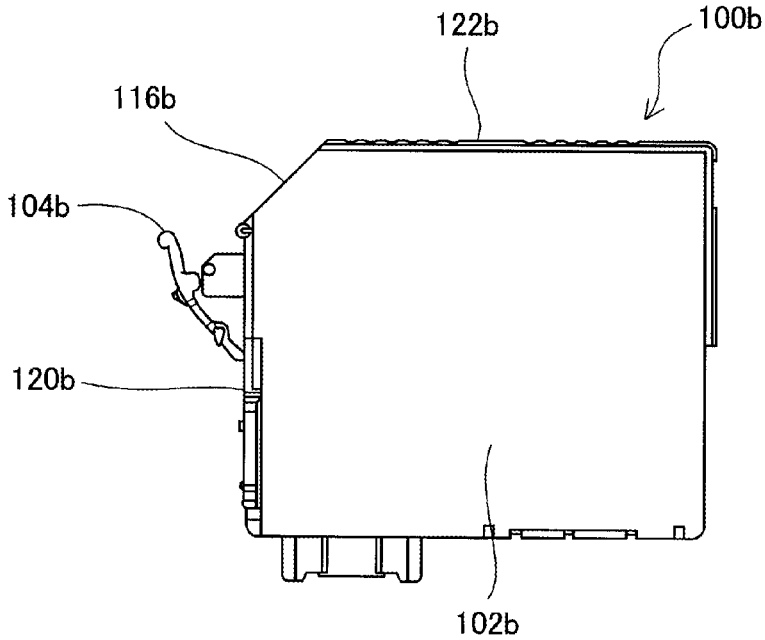
FIG. 6 is a side view of an ink cartridge as a second embodiment of the present invention.

FIG. 6 is a side view of an ink cartridge 100*b* as a second embodiment of the present invention. With this embodiment, the cutout portion 116*b* of the ink cartridge 100*b* is constituted by one flat plane extending from the front surface 120*b* to the top surface 122*b* of the ink container portion 102*b*. The position of the cutout portion 116*b* in relation to the fixing lever 104*b* is the same as with the first embodiment. With this kind of cutout portion 116*b* as well, it is possible to obtain the same effects as with the first embodiment.

Figure 7:
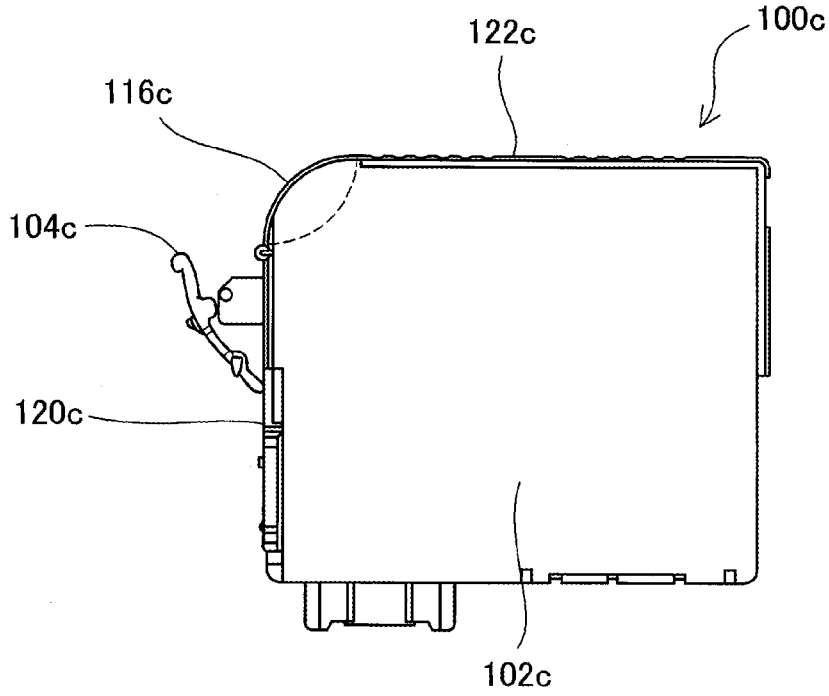
FIG. 7 is a side view of an ink cartridge as a third embodiment of the present invention.

FIG. 7 is a side view of an ink cartridge 100*c* as a third embodiment of the present invention. With this embodiment, the cutout portion 116*c* of the ink cartridge 100*c* is constituted by a curved surface extending from the front surface 120*c* to the top surface 122*c* of the ink container portion 102*c*. The position of the cutout portion 116*c* in relation to the fixing lever 104*c* is the same as that of the first embodiment. With this kind of cutout portion 116*c* as well, it is possible to obtain the same effects as with the first embodiment. Note that the cutout portion 116*c* may have a convex shape expanding toward the outside of the ink cartridge 100*c* as shown by the solid line in FIG. 7, and may also have a concave shape depressed toward inside the ink cartridge 100*c* as shown by the dotted line. Also, the cutout portion 116*c* may be constituted by not just a curved surface, but also by a combination of one or more curved surfaces and one or more flat surfaces.

Figure 8:
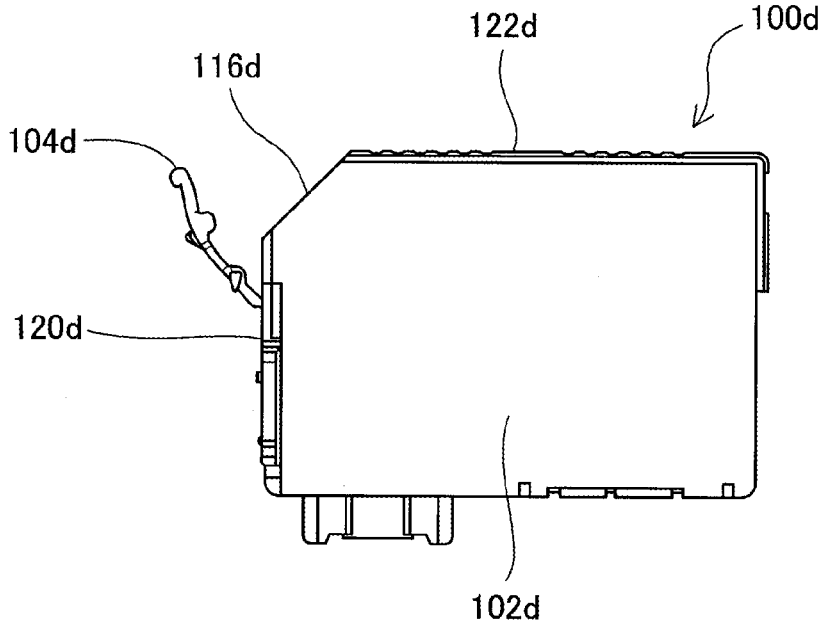
FIG. 8 is a side view of an ink cartridge as a fourth embodiment of the present invention.

FIG. 8 is a side view of an ink cartridge 100*d* as a fourth embodiment of the present invention. With this embodiment, the cutout portion 116*d* and the fixing lever 104*d* are provided at positions such that they are substantially opposite to each other, and that the top surface 122*d* of the ink container portion 102*d* is substantially horizontal with the top edge of the fixing lever 104*d* provided on the front surface 120*d*. Although the cutout portion 116*d* is provided at a position lower than those in the above embodiments, the cutout portion 116*d* is provided near the fixing lever 104*d*, and this structure increases the detachability of the ink cartridge 100*d*. Note that with this kind of constitution as well, it is possible to modify the cutout portion 116*d* as appropriate.

Various embodiments of the present invention are described above, but the present invention is not limited to these embodiments, and it is possible to use various constitutions in a range that does not stray from its gist. For example, the following variations are possible.

With the above embodiments, the fixing lever 104 has the fixed end 141 provided on the bottom surface 121 side, and the free end 142 on the top surface 122 side. However, the structure of the fixing lever 104 is not limited to this, and it is also possible to have other structure as long as operation of the lever is possible through the cutout portion 116. For example, it is also possible to provide the free end on the bottom surface 121 side, and to provide the fixed end 141 on the top surface 122 side. It is also possible to provide the fixing lever 104 so that the fixed end 141 and the free end 142 extend in the horizontal direction (direction perpendicular to direction D) in FIG. 1B.

With the embodiments noted above, the ink supply port 112 is provided at the bottom surface 121 of the ink container portion 102, but the ink supply port 112 may also be provided on the front surface 120 of the ink container portion 102, or the back surface or side surface facing opposite the front surface 120.

The embodiments of the present invention are applied to an ink cartridge and ink jet printer, but the present invention may also be applied to a liquid consuming device that sprays or discharges other liquid besides ink, and may also be applied to a liquid container that holds that kind of liquid. Also, the liquid container of the present invention may be applied to various types of liquid consuming devices equipped with a liquid jetting head for discharging tiny volume droplets or the like. A "droplet" means the state of a liquid discharged from the aforementioned liquid consuming device, and includes particle shape, tear shape, and threadlike items with a tail. Also, "liquid" here means any material that may be ejected by the liquid consuming device. For example, it is acceptable as long as it is an item in a state when the physical property is a liquid phase, and this includes not only a high or low viscosity liquid state, a fluid state such as a sol, gel water, another inorganic solvent, organic solvent, liquid solution, liquid state resin, liquid state metal (metallic melt), or a liquid of a single state property, but also includes items for which particles of a functional material consisting of solid matter such as pigment, metal particles or the like are dissolved, dispersed, or mixed in a solvent or the like. Also, as a representative example of a liquid, we may list the kind of ink described with the embodiments noted above, a liquid crystal or the like. Here, "ink" means items containing various types of liquid compositions such as typical water based inks and oil based inks as well as gel ink, hot melt ink and the like. As a specific example of the liquid consuming device, for example, this may be a liquid consuming device that sprays liquid for which a material such as an electrode material or coloring material or the like is contained in a dispersed or dissolved form used for manufacturing of liquid crystal displays, EL (electro luminescence) displays, surface emitting displays, color filters or the like, a liquid consuming device that sprays a biological organic substance used for biochip manufacturing, or a liquid consuming device that sprays liquid that becomes a sample used as a precision pipette. Furthermore, it may also be used for a liquid consuming device that sprays lubricant oil using a pinpoint for precision instruments such as clocks, cameras or the like, a liquid consuming device that sprays onto a substrate a transparent resin liquid such as an ultraviolet ray hardening resin or the like for forming a micro hemispherical lens used for optical communication components or the like, or a liquid consuming device that sprays an etching liquid such as acid or alkali or the like to etch a substrate or the like.

What is claimed is:

1. A liquid container to be mounted on a liquid consuming device, comprising:

a fixing lever that engages with a designated portion of the liquid consuming device, thereby fixing the liquid container in the liquid consuming device;

a first surface on which the fixing lever is provided;

a second surface on which a liquid supply port is provided for supplying liquid to the liquid consuming device;

a third surface, which corresponds to a surface facing opposite the second surface or to a top surface of the liquid container in a state with the liquid container mounted on the liquid consuming device;

a corner having a cutout in contact with the first surface and the third surface; and a projected portion that projects further to the third surface side than a free end of the fixing lever in a direction along the first surface, the projected portion increasing a liquid capacity of the liquid container, wherein the corner having the cutout is provided in the projected portion.

2. The liquid container according to claim 1, wherein the fixing lever has a fixed end fixed on the first surface, and the free end that is displaceable toward the first surface during mounting operation of the liquid container to the liquid consuming device, and when seen in the direction along the first surface, the free end is located closer to the third surface than the fixed end is.

3. The liquid container according to claim 2, wherein the cutout of the corner is provided near a position of the free end when the free end of the fixing lever is displaced toward the first surface.

4. The liquid container according to claim 2, wherein the cutout of the corner meets the first surface near a position of the first surface which is opposite to the free end of the fixing lever when the free end is displaced toward the first surface.

5. The liquid container according to claim 1, wherein the cutout of the corner is formed by a flat surface.

6. The liquid container according to claim 3, wherein the cutout of the corner meets the first surface near a position of the first surface which is opposite to the free end of the fixing lever when the free end is displaced toward the first surface.

7. The liquid container according to claim 1, wherein the cutout of the corner is formed by a curved surface.

8. The liquid container according to claim 1, wherein the cutout of the corner is formed by a combination of flat and curved surfaces.

* * * * *